United States Patent [19]

Munier

[11] 4,381,076

[45] Apr. 26, 1983

[54] DROPPED RAILROAD TIE FOR RAILWAY WITHOUT BALLAST

[75] Inventor: Rene Munier, Choisy Au Bac, France

[73] Assignee: Regie Nationale des Usines Renault, Boulogne-Billancourt, France

[21] Appl. No.: 159,341

[22] Filed: Jun. 13, 1980

[30] Foreign Application Priority Data

Jun. 15, 1979 [FR] France ..... 79 15391

[51] Int. Cl.[3] ..... E01B 3/40

[52] U.S. Cl. ..... 238/115; 238/85; 238/109; 238/265

[58] Field of Search ..... 238/29, 42, 84–94, 238/109, 115–117, 264–266, 269–271, 298; 52/729, 738

[56] References Cited

U.S. PATENT DOCUMENTS

| | | | |
|---|---|---|---|
| 942,650 | 12/1909 | Krepps | 238/265 X |
| 1,071,361 | 8/1913 | Sisk | 238/265 X |
| 1,128,668 | 2/1915 | Earll | 238/265 |
| 1,351,819 | 9/1920 | Whitcomb | 238/265 |
| 1,622,259 | 3/1927 | Lipham | 238/115 |
| 1,788,913 | 1/1931 | Greenwood | 238/115 |
| 2,201,047 | 5/1940 | Moore et al. | 52/729 X |
| 3,333,389 | 8/1967 | Lichti | 52/729 |
| 3,960,637 | 6/1976 | Ostrow | 52/729 X |

FOREIGN PATENT DOCUMENTS

| | | | |
|---|---|---|---|
| 421322 | 5/1937 | Belgium . | |
| 97008 | 12/1922 | Switzerland . | |
| 11951 | of 1914 | United Kingdom . | |
| 488153 | 7/1938 | United Kingdom | 238/265 |
| 1419565 | 12/1975 | United Kingdom | 238/115 |

*Primary Examiner*—Randolph Reese

*Attorney, Agent, or Firm*—Oblon, Fisher, Spivak, McClelland & Maier

[57] ABSTRACT

The construction of steel-concrete railroad ties onto which rails are fixed is disclosed. The ties are composed of a metal saddle for fastening to the rail, comprising a tie-plate extending over a part of the upper surface of the tie and forming the zone for attachment and support of the rail. The tie-plate further extends into the tie through ribs sealed in the concrete of the tie and constitutes at least part of its reinforcement.

1 Claim, 6 Drawing Figures

DROPPED RAILROAD TIE FOR RAILWAY WITHOUT BALLAST

BACKGROUND OF THE INVENTION

1. Field of the Invention

The present invention relates to a steel-concrete railroad tie construction in which the rails are supported on ties in the form of blocks of reinforced concrete possibly connected in pairs of cross-ties including a metal truss having its ends sealed in said ties.

2. Description of the Prior Art

This type of tie is mainly used in non-ballasted rails, where the ties rest on plates of vibration deadening material, directly supported in concrete bearings, in which they are generally embedded. These rails appear particularly in rail transport systems in tunnels, where the absence of ballast enables considerable reduction in tunnel height.

However, despite the use of reinforced concrete for reducing the need for trussings, the reinforced concrete structure of the ties requires that they be given a certain dimensional mass in order to have the required solidity and rigidity. Consideration must be given to the great pressures concentrated on the center of the tie at the rail upright during the passing of trains, which tend to stress the concrete in repeated centrally-applied flexures, something which is not desirable for concrete blocks.

It follows that, in order to resist these flexures, the ties must necessarily be rather massive, especially in height, which runs counter to the desired goal of a rail assembly which is as low as possible.

SUMMARY OF THE INVENTION

The present invention has as an object a tie structure not having the above drawbacks, while retaining sufficient strength and a simple and economical construction.

In the invention, the upper surface of the tie includes a metal saddle for supporting and attaching the rail by means of an upper tie-plate which extends downwards in ribs which are sealed in the concrete of the tie, forming a truss.

Advantageously, the saddle will have the general shape of an inverted "U", the vertical flanges of which will be sunken in the concrete of the tie. The upper tie-plate will cover the stressed part of the surface of the tie.

From this structural combination of a metal truss in the form of a saddle covering the concrete block in which it is sealed by its flanges, it follows that the part of the flexural stress exerted by the concentrated pressure of the rail will be borne by the very rigid, metal U-structure of the saddle, under which the concrete of the tie will be stressed essentially in compression. The height of the tie may thus be reduced by the maximum extent. Practically, it will have to be only slightly higher than the flanges of the saddle, enough to ensure that they are properly sealed and to transmit the pressure exerted by the saddle uniformly to the deadening plate on which the tie rests.

The saddles may be constructed from steel plates cut and bent into a U shape. The flanges of the U may be of decreasing height moving from the midpoint to the ends, thus giving the classic shape of a flexure beam. Classic round bar trussings may possibly be added to the saddle, e.g., with their outer frame pinching the outer surfaces of the flanges of the U.

According to a preferred embodiment, the saddle will be made of cast iron, with its shape enabling economical casting without coring, said casting enabling attachment holes and chock stops for the rail attachment elements to be obtained directly from the foundry, together with additional ribs enabling reinforcement, if necessary, of the support girder formed by the saddle, as well as its sealing within the concrete of the tie. More generally, therefore, the reinforced concrete, dropped railroad tie according to the invention consists essentially of a metallic saddle, of which an upper tie-plate receives the rail foot and attachment and extends downwards in ribs sealed within the concrete of the tie, forming a reinforcement.

The saddle preferably is in the general shape of an inverted U, of which the base, or tie-plate rests upon, and the two flanges are sunken in, the concrete of the tie.

These flanges, or ribs, decrease in height from their zone of support of the rail toward their ends, giving the saddle the form of an equal-resistance beam.

The saddle may be made of cast metal such as iron, with the rail support tie-plate then being rigidified by a network of ribs obtained through casting, e.g., with said ribs cross-ruling the lower surface of the tie-plate.

The tie-plate is advantageously flanged with a peripheral rib comprising outer ribs at the points of connection with the inner cross-ruled grid ribs, on the longitudinal border of the tie-plate, in order to increase the anchorage of the truss.

According to another type of construction, the saddle would be a steel plate, cut and bent into a U-shaped section.

The two flanges of this U section may be embedded by wedging them within the outer frame of a reinforcement trussing having the form of a concrete-round bar flat grill.

The support thrusts and rail clip attachment openings could be provided in the tie-plate of the saddle and formed, according to the type of construction, either directly by casting or by cutting, dovetailing, and/or soldering of attached elements.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
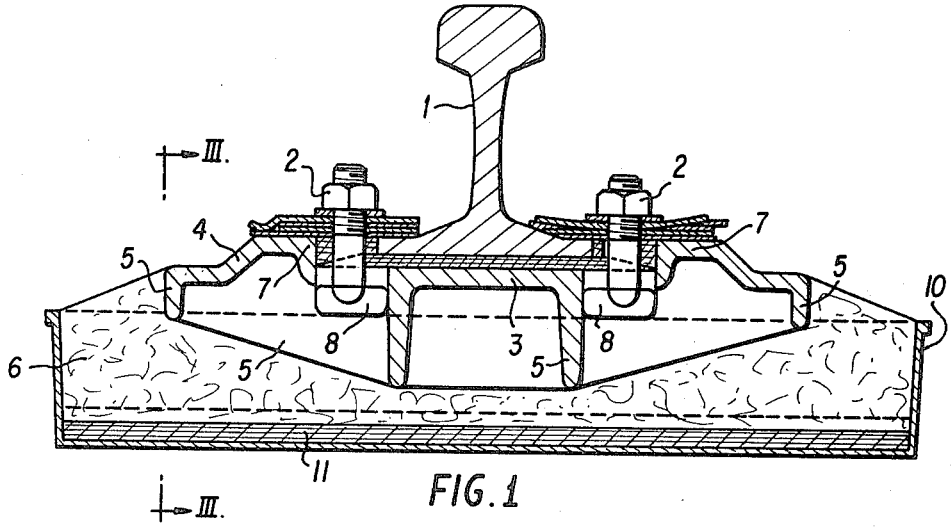
FIG. 1 shows, in a I—I axial, longitudinal cross-section of FIG. 2, a tie according to the preferred embodiment of the invention, with a saddle of foundry-cast material.

In FIG. 1, a rail 1, fastened in the usual fashion by clips 2, rests on a tie-plate 3, forming the upper plate of a saddle 4, made of cast material such as iron. The tie-plate extends vertically downward in a system of ribs 5, which are sealed in the concrete of tie block 6. Tie-plate 3 and its system of ribs 5 give saddle 4 a ribbed girder structure which is highly rigid under flexure.

Tie-plate 3 includes contours 7 which form support thrusts for the rail fastening system, and openings 8 for passage and fastening of the bolt heads of rail clips 2.

Figure 2:
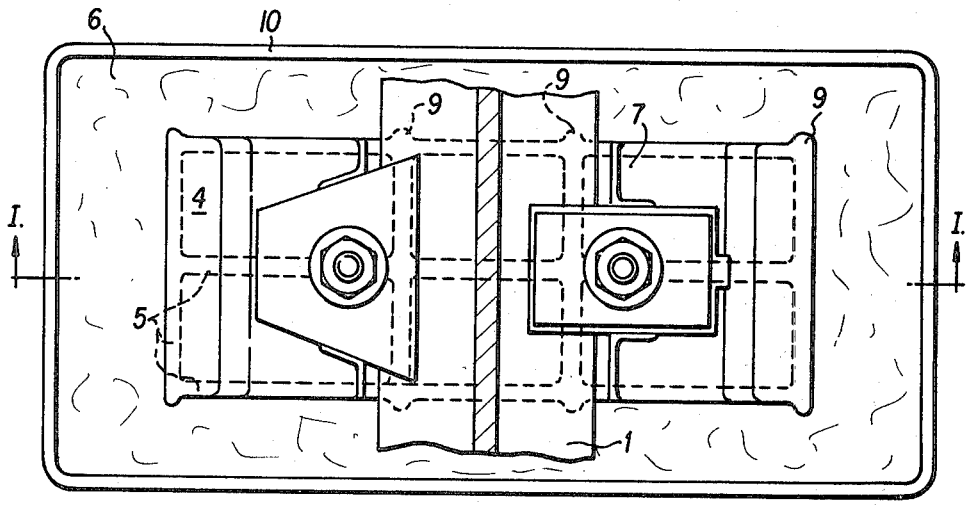
FIG. 2 represents the tie in a top view.
Figure 3:
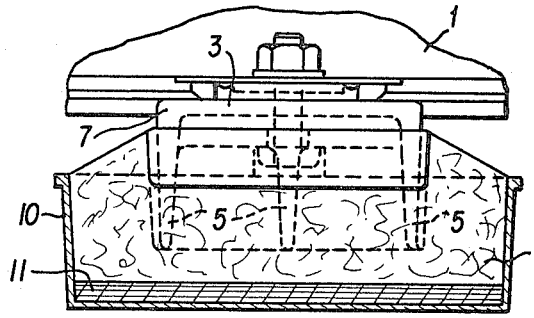
FIG. 3 represents the tie in transverse cross-section along cut III—III of FIG. 1.

Two different types of clips are represented on either side of the rail in FIGS. 1 and 2, in order to illustrate the adaptability of this type of tie to the various fastening systems.

FIGS. 1 and 2 show a system of ribs 5 cross-ruling the lower surface of tie-plate 3 and, at 9, slightly exceeding their junction with a peripheral rib of tie-plate 3, which increases the anchorage of the tie-plate in the concrete of tie block 6, and enables all other classical auxiliary trusses to be eliminated. Block 6 is shown equipped with a shoe 10 and sole-plate 11 of the type used for deadening vibrations in non-ballasted railways.

Figure 4:
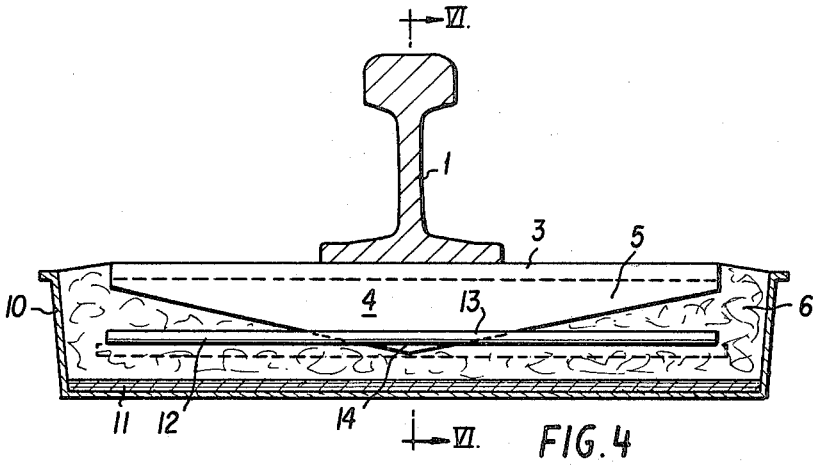
FIG. 4 represents a tie of the invention, in which the saddle is constructed from a steel plate, cut and shaped into a U, in longitudinal cross-section along cut IV—IV of FIG. 6.
Figure 5:
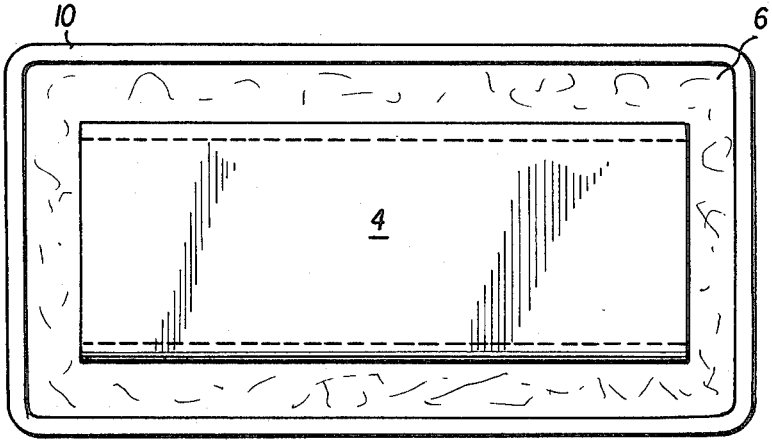
FIG. 5 is a top view of the arrangement of the saddle in the tie of FIG. 4.
Figure 6:
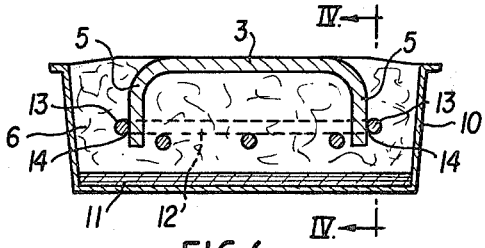
FIG. 6 shows, in cross-section along cut VI—VI the transverse sections of the saddle and tie of FIG. 4.

According to another embodiment of the invention which may prove more advantageous according to available industrial means, saddle 4 may be made from thick metal plate cut and bent into a U as shown in FIGS. 4, 5 and 6, in which, in the interest of simplifying the drawings, the fastening systems for rail 1 are not shown but may be provided by appropriate openings in tie-plate 3 and chocks which may either be wedged into said openings, cut directly, or formed from metal studs soldered onto said tie-plate according to the type of fasteners used.

The limitations inherent in this embodiment limit ribs 5 to two longitudinal ribs, giving the saddle a U-beam shape. These longitudinal flanges may, as in the preceding case, decrease in height from the middle to the ends according to a classic equal-resistance shape for such flexure beams. This limitation to two longitudinal ribs may be compensated for, if needed for heavily loaded railways, by a classic concrete-round bar reinforcement truss, here taking the shape (as shown in FIGS. 4 and 6) of a flat grill 12 capable of being wedged, by its outer frame 13, on either side of ribs 5, using the residual inclination of the latter to bend. This wedging, at 14, enables truss 13 to be held in place during the pouring and setting of the concrete.

It will be observed that in the two embodiments described, concrete block 6 is reduced in height to the minimum needed for covering the lower part of saddle 4, and that its role is confined to transmitting by simple compression (a form of stress for which concrete is well-adapted), the concentrated pressures from rail 1, received through saddle 4, to deadening plate 11, in the form of evenly distributed pressure.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A dropped railroad tie comprising:

a concrete tie block having an upper surface; and a metal saddle in said block, said metal saddle including a tie-plate covering a support area of said upper surface and adapted to receive the foot and fastenings of a rail in said support area, and a plurality of ribs transversely fixed to said tie plate and forming a first truss, said ribs extending into said tie block and being sealed in the concrete of said tie block, wherein at least some of said ribs extend parallel to the length of said tie and decrease in height from said support area toward the ends of said ribs, whereby said saddle approximates an equal stress resistance beam, whereby said saddle absorbs flexure stresses and transmits compressive stresses to said tie block, wherein said saddle is formed of a cut steel plate shaped in a U section, the flanges of which form said ribs and wherein the outer frame of a round bar flat grill second truss wedgingly encloses said flanges within said tie, whereby said outer frame of said second truss reinforces said saddle against bending stresses.

* * * * *